United States Patent [19]

Albenga

[11] 3,983,922

[45] Oct. 5, 1976

[54] HOLLOW FOUNDRY CORE MOULDING APPARATUS

[76] Inventor: Giovan Battista Albenga, Viale Matteott 73, Pavia, Italy

[22] Filed: Apr. 23, 1975

[21] Appl. No.: 570,704

[30] Foreign Application Priority Data

May 8, 1974 Italy ..... 22405/74

[52] U.S. Cl. ..... 164/183; 164/186; 164/232; 425/438

[51] Int. Cl.[2] ..... B22C 17/08

[58] Field of Search ..... 164/44, 45, 183, 186, 164/224, 228, 229, 340, 345, 397, 402, 232; 425/438, 468

[56] References Cited

UNITED STATES PATENTS

| | | | |
|---|---|---|---|
| 1,968,703 | 7/1934 | Peyinghaus | 164/224 |
| 3,589,431 | 6/1971 | Fellows | 164/201 |

FOREIGN PATENTS OR APPLICATIONS

| | | | |
|---|---|---|---|
| 549,556 | 11/1922 | France | 164/45 |
| 278,048 | 2/1972 | U.S.S.R. | 164/186 |

*Primary Examiner*—Robert D. Baldwin
*Attorney, Agent, or Firm*—Michael J. Striker

[57] ABSTRACT

A moulding process includes closing a multi-part die onto hollow-forming members to produce a hollow core mould. The mould is used in the "cold" process to produce a hardened foundry core about the cavity-forming members. Parting the die causes the cavity-forming members and the hardened core to be pivoted so that the hardened core rests on a conveyor belt with the longitudinal axes of the cavity forming members aligned with the longitudinal axis of the conveyor belt and with the cavity forming members lying in respective slots in a web fixed transverse to the conveyor belt. Subsequent movement of the conveyor belt causes the web to abut the hardened core and to extract the cavity-forming member from the hardened core as the hardened core is moved on the conveyor belt. In a modification of the process, the cavity forming members are partly extracted from the hardened core before the pivoting movement takes place. The apparatus used for the process has part of the die linked by a lost-motion mechanism to a bracket which carries the cavity forming members and which is pivotally mounted on two arms which are fixed on parallel bars which are slidably supported with respect to another part of the die. The parallel bars have helical springs to aid the movement of the other part of the die away from the hollow-forming members. The lost-motion mechanism is spring-biased to return the cavity forming members to a position between the die parts as they approach each other. The cavity forming members are axially movable with respect to the bracket by means of a hydraulic jack.

8 Claims, 4 Drawing Figures

HOLLOW FOUNDRY CORE MOULDING APPARATUS

BACKGROUND OF THE INVENTION

FIELD OF THE INVENTION

The present invention relates to a process for moulding and for ejecting hollow foundry cores. This invention also relates to an apparatus for performing the process.

DESCRIPTION OF THE PRIOR ART

In moulding of foundry cores using the so-called "cold" process two important problems heretobefore have been regarded separately, and accordingly they have been solved independently, the solution of one problem excluding the solution of the other one.

The first problem concerns the production of hollow cores, i.e. cores which are produced with internal cavities, with the aims of decreasing the weight, increasing the handling capabilities, and saving moulding sand, which, as is well known, is treated with cemented substances which harden through the action of a gas, $CO_2$ for instance, blown into the mould, or through the action of a catalyst and consequently has a cost which has an important effect on the production cost of the cores.

Heretobefore to produce hollow cores, a number of parallel bars projecting upwardly from a movable support have been used. The bars are arranged to extend into the cavity of the closed mould; the moulding is carried out; the mould is opened for removal of the cores produced; the support, the bars, and the cores are removed from the mould; and finally, the support and the bars are manually removed from the cores. This procedure necessarily requires a manual extraction of the bars from the cores produced, therefore precluding the automatic extraction of the bars from the cores thus involving, of course, strenuous work in the case of heavy cores.

Different methods for automatic ejection of the cores from the mould and for placing them onto a conveyor belt have been used. These methods generally require that, after the mould is opened, the parts of the mould to which the moulded cores are attached are moved to position the moulded core over a conveyor belt and then the moulded core is ejected from the die part onto the conveyor belt. Such a method of core ejection, although acceptable as regards the ejection of the core from the mould, has the disadvantage that it is not suitable for the production of hollow cores, so that the production of such cores by means of the prior methods used above would obviously be very expensive.

SUMMARY OF THE INVENTION

The present invention has the purpose of solving simultaneously the two problems, since it allows as a result of entirely automatic extraction of the bars from the cores, both fully automatic production of hollow cores, and high capacity rate and an important saving of materials.

According to one aspect of the present invention there is provided a process for moulding a hollow foundry core around a bar-shaped member and automatically extracting the bar-shaped member from the moulded core, which comprises:

a. closing complementary parts of a die around a bar-shaped member projecting into a space defined by the parts of the closed die, said bar-shaped member being fixed to a support member;
b. blowing material for moulding a core into the closed die such that the core is moulded around the portion of said bar-shaped member contained within the closed die;
c. hardening the mould material;
d. opening the die;
e. pivoting the support means and thereby the hardened core simultaneously with the opening movement of part of said die to move the hardened core onto a conveyor so that an end of the hardened core is adjacent a web on the conveyor;
f. moving the conveyor to move the web against the hardened core to move the hardened core in order to extract the bar-shaped member therefrom.

According to a modification of the process, a step of releasing said bar-shaped member from said hardened core is carried out immediately after said step of hardening the mould material. According to another aspect of the invention there is provided a process wherein the support member and thereby the bar-shaped member carry out a return pivoting movement initiated by the closing movement of the die.

Preferably the linking means is connected to said support means by a lost-motion mechanism such that said support means and said at least one bar-shaped member are caused to pivot from said first-position to said second position as said one die part approaches the maximum separation from the other of said die parts; and wherein said lost-motion mechanism is spring-biassed to urge said support means and said at least one bar-shaped member from said second position to said first position as said one die part moves towards the other of said die parts.

The invention is now described in greater detail, by way of example only, with reference to the accompanying drawings, in which:

DESCRIPTION OF THE PREFERRED EMBODIMENT

Figure 1:
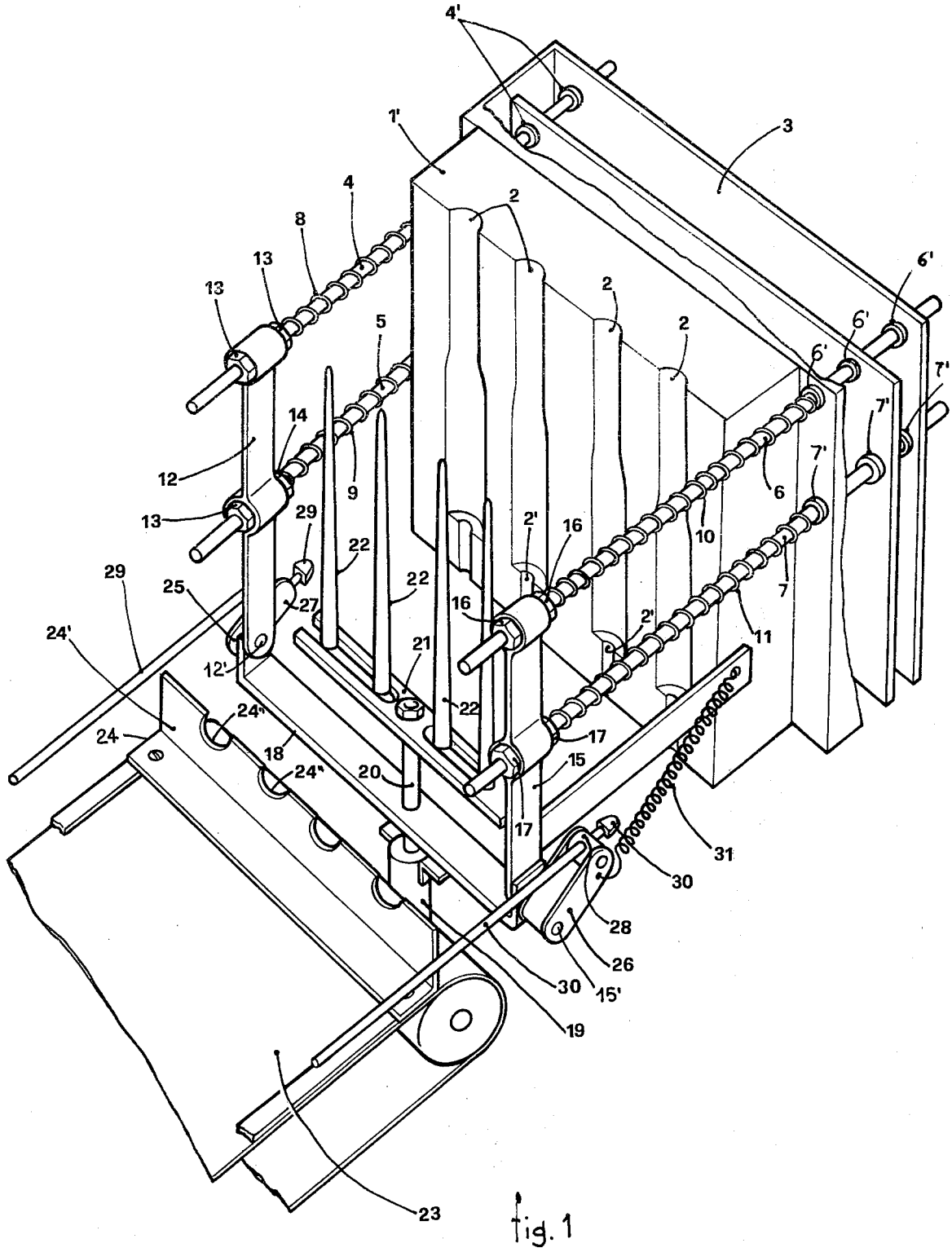
FIG. 1 is a perspective view showing part of a moulding apparatus in the open position.
Figure 2:
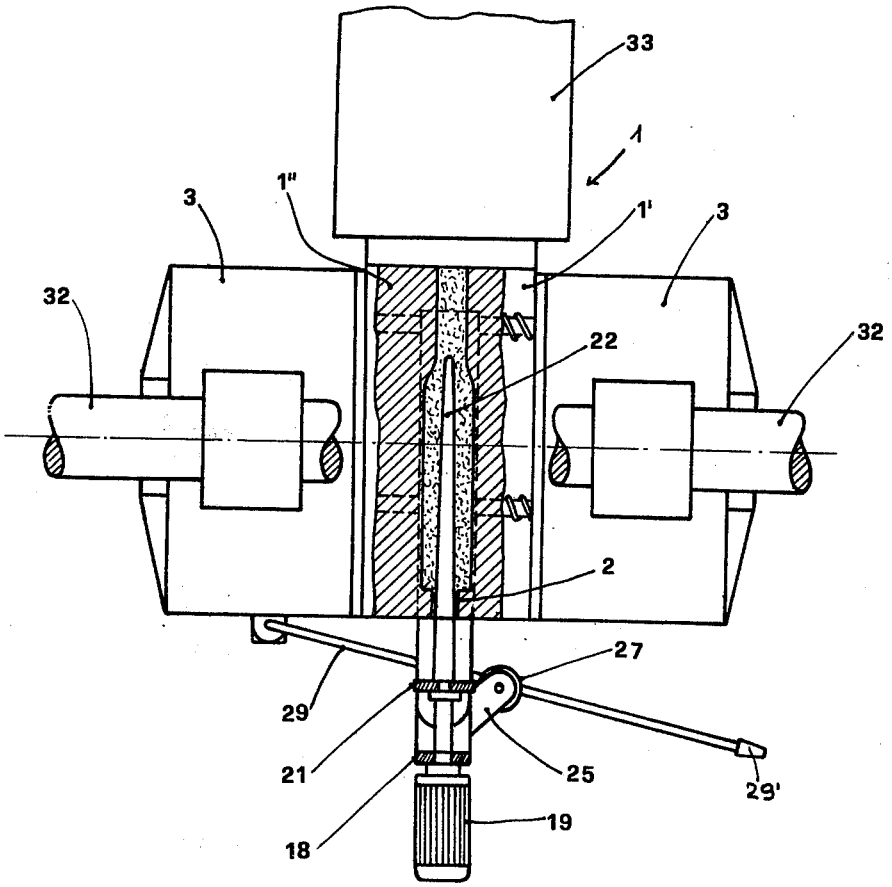
FIG. 2 is a part of the front elevation of the apparatus shown in FIG. 1 in the closed position and with the central portion showing a moulded core in section.
Figure 3:
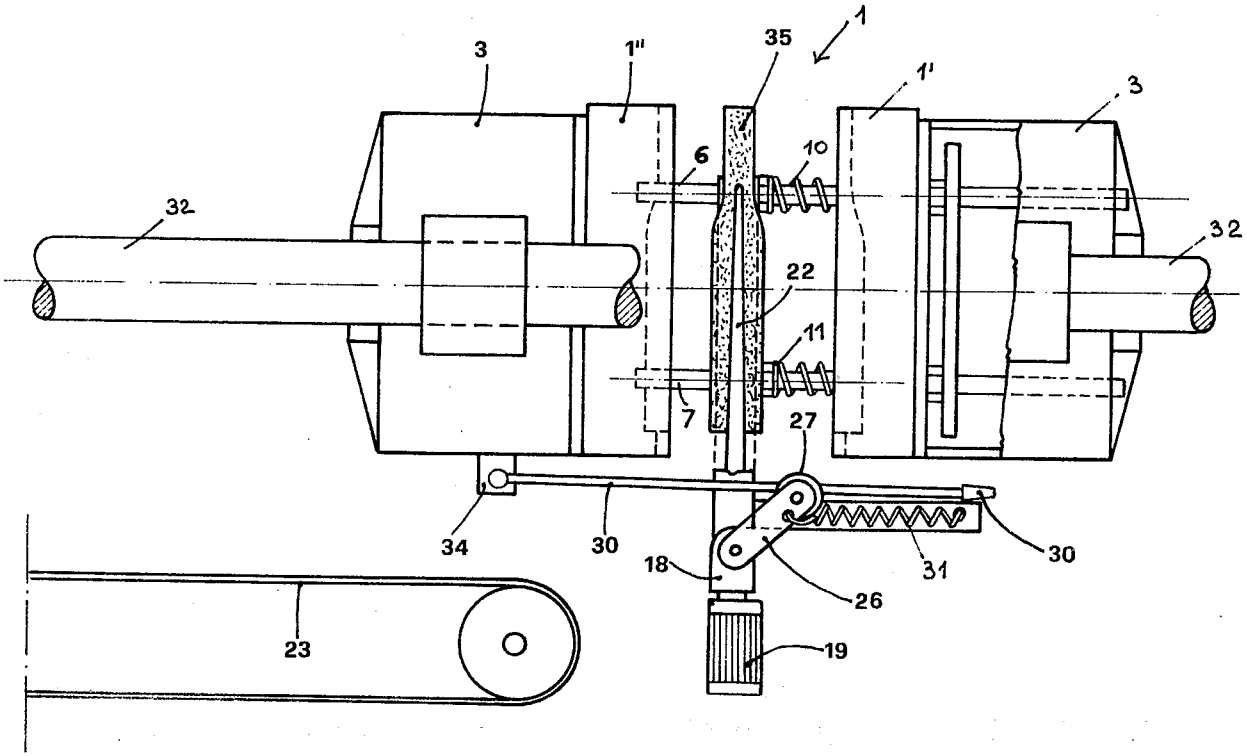
FIG. 3 is part of the front elevation of the apparatus shown in FIG. 1 in the partly opened position and with the moulded core shown in section.
Figure 4:
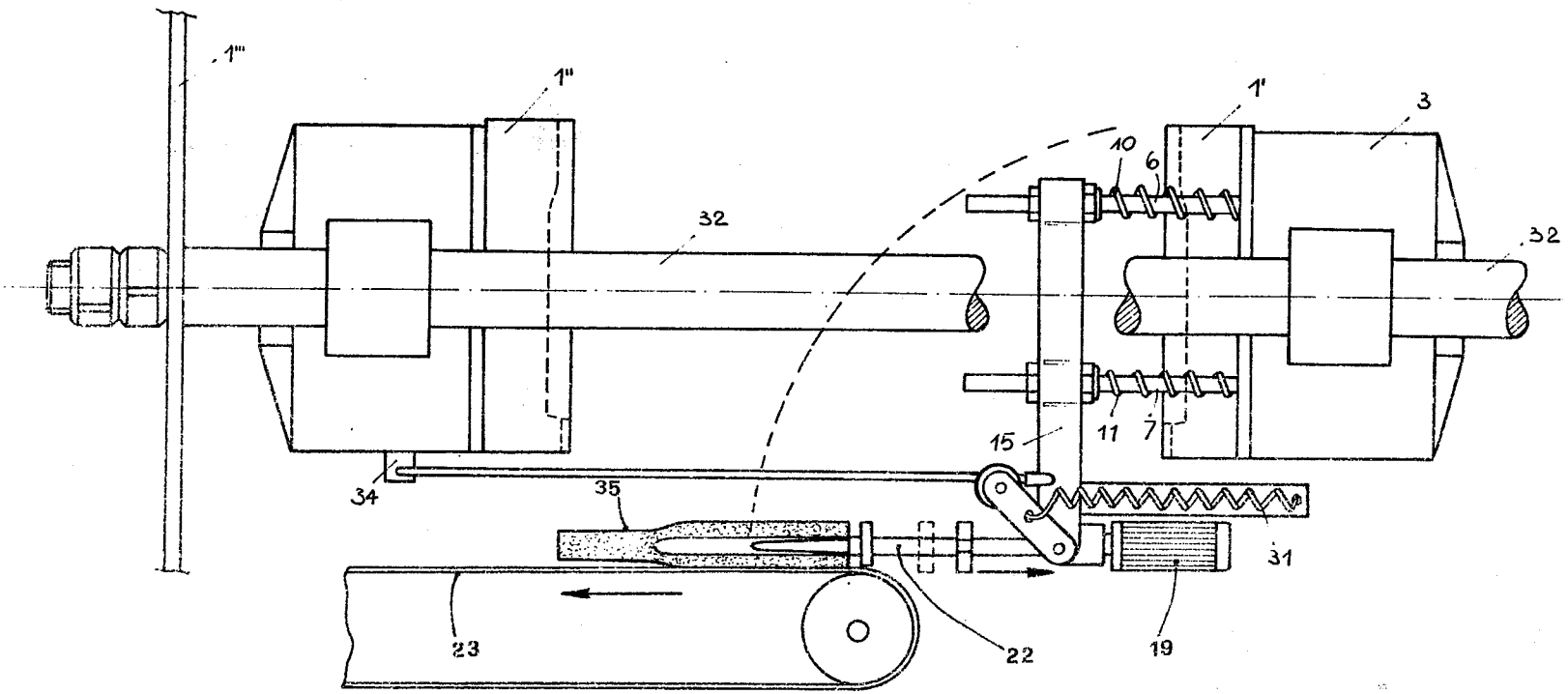
FIG. 4 is part of the front elevation of the apparatus shown in FIG. 1 in the open position and with the moulded core shown in section.

In FIG. 1, the number 1′ indicates a part of a pair of die or mould parts 1′and 1″ (die part 1″ shown in FIGS. 2, 3, and 4) of a multi-part die press 1 mounted in a frame 1‴ and used for the production of foundry cores. The die part 1′ has four cavities 2 of part-circular cross-section which define the shape of one side of the cores to be produced. As shown in FIGS. 2, 3, and 4, the die parts 1″ also has four part-circular cavities 2 (only one shown) which coincide with the cavities 2 on the die part 1′.

The die part 1′ is equipped at its rear portion with a hollow part 3, of known type, in which known ejecting devices (not shown) are housed for ejecting cores after their formation. The die part 1'' also has a hollow part 3.

According to this present invention, two pairs of bars 4 and 5, and 6 and 7 respectively, project from the two sides of the hollow part 3 attached to the die parts 1'. The rear portion of the bars slide through respective holes (only the hole 4', 6' and 7' for the bars 4, 6 and 7 are shown) provided in the hollow part 3 of the die part 1'. The bars 4, 5, 6 and 7 are encircled by helical springs 8, 9, 10 and 11 respectively which impart a pushing action along the bars and against the die part 1'.

The bars 4 and 5 are connected to a vertical arm 12; positions of the bars on the arm 12 are adjustable by means of respective pairs of nuts 13 and 14. The bars 6 and 7 are connected to a similar vertical arm 15 and the position of the bars 6 and 7 are also adjustable in the same manner by means of respectve pairs of nuts 16 and 17.

Because of the arrangement of bars 4, 5, 6 and 7, the arms 12 and 15 do not prevent the movement of the die parts 1' and 1'' relative to each other, and therefore the die parts 1' and 1'' may move freely between the closed position (FIG. 2) and the open position (FIG. 4).

The respective lower ends of the arms 12 and 15 are hinged by pins 12' and 15' respectively to the short arm of a bracket 18 parallel with and below the opposed faces of the die parts 1' and 1''. The bracket 18 may thus pivot about the arms 12 and 15.

Under the bracket 18 is a fluid-operated, i.e. hydraulic- or air-operated, jack 19 which is supported on the bracket 18. The jack 19 has a stem 20 which passes through the bracket 18 to support at its end a support bar 21, the which is parallel to the bracket 18. The support bar 21 has four bar-like members 22 for forming cavities in the cores, and secured to said support bar 21 so that there axes are aligned with the respective longitudinal axes of the part-circular cavities 2 on the die parts 1' and 1''.

The support bar 21, when at its highest or first, position, is below the bottom face of the die part 1', and the members 22 are of such a height as to extend to the part-circular cavities 2, the bottom of the part-circular cavities 2 having semi-circular openings 2' permitting the respective members 22 to pass through. The other die part 1'' (shown in FIGS. 2, 3 and 4) also has the openings 2', and therefore in the closed position (FIG. 2) of the two die parts 1' and 1'' the cavities 2 and the openings 2' will form cylindrical passages coaxially enclosing portions of the members 22 in the first position.

The support bar 21 is guided by the stem 20 towards the bracket 18, but when the die parts 1' and 1'' are approaching or are separating, and during the pivoting motion (described later) of the bracket 18 about the hinge pins 12' and 15' which connect the bracket 18 to the arms 12 and 15. Thus the members 22 may be within or outside the cavities 2, and may be pivoting with the bracket 18 to a horizontal, or second, position above a conveyor belt 23 onto which is attached a shoulder 24 having a transverse web 24' adapted to abut against the cores produced and the web 24' having slots 24'' for receiving the members 22 and for removing the same from the cores in the manner explained hereunder.

The pivoting motion of the bracket 18 is carried through a lost-motion mechanism such as two side links 25 to 26 which at one end are keyed onto the respective hinge pins 12' and 15' of the bracket 18 and at the other end are pivotally connected to respective rotatable members 27 and 28 in which are slidably mounted the respective rods 29 and 30. The rods 29 and 30 slide in respective holes in the respective members 27 and 28 until respective enlarged ends 29' and 30' of the rods 29 and 30 rest against the member 27 and 28 respectively to pivot them to the left, and therefore cause a counter clockwise rotation around the hinge pins 12' and 15' and accordingly pivoting the bracket 18 and the members 22 from the vertical, or first position shown in FIGS. 1, 2, and 3 to the horizontal, or second, position shown in FIG. 4.

A pair of traction springs 31 (only one shown) have the purpose of returning the bracket 18, and the members 22 mounted on it, back from the horizontal, or second, position to the vertical, or first, position.

The members 22 may be of different dimensions, regarding the height, and their cross-section, according to the dimensions of the cores to be produced. The members 22 may, for example, have a needle-like cross-section for very thin cores, and may also have a cross-sectional diameter larger than their length.

The apparatus illustrated above with reference to FIG. 1 may be mounted on a press with horizontal travel or the apparatus may be mounted onto presses with die parts moving vertically. Of course, the apparatus may need modification to the dimensions of the parts and to the angle through which the bracket 18 is pivoted.

The parts of the apparatus for the support and the movement of the members 22 may be supported by means other than hollow part 3 of the die part 1'; for example, by mounting the bars 4, 5, 6 and 7 which support the entire apparatus, onto supports (not shown) on the frame 1''' of the die press 1.

The operation of the process using the apparatus previously described will now be described with reference to FIGS. 2, 3 and 4, as well as FIG. 1.

At the start of each single cycle of operation, die parts 1' and 1'' which are slidably mounted on the supporting bars 32 of the die press 1, are moved towards one another. Generally, the die part 1' is stationary, while the die part 1'' slides along the supporting bars 32 and is moved between the closed position (FIG. 2) and the open position (FIG. 3) with respect to the die part 1' by means of a hydraulic- or air-operated jack (not shown), according to the system known in the art. When the die part 1'' approaches the die part 1' (FIG. 2), the die part 1'' pushes against the bars 4, 5, 6 and 7 and urges the elements mounted thereon towards the die part 1', in particular the members 22 will be urged towards the cavities 2 in the die part 1' while the bars 4, 5, 6 and 7 slide through the respective holes 5', 6', 7', and 8' against the pressure of the springs 8, 9, 10, and 11. The die part 1'' will reach the closed position with die part 1' (as shown in FIG. 2) with the members 22 projecting into the respective complete cavities 2 and projecting through the respective openings 2'. In this condition, sand is blown into the cavities 2 using a known tank 33 and the sand is hardened, for example by means of a blowing head (not shown) supplying hardening gas, after the blowing hand replaces the tank 33 in a known manner.

It should be observed that in FIG. 2 sand, in addition to filing the cavity 2 of the die part 1' and 1'' to form the required core, will form the cores round the members 22. The members 22 are dimensioned for producing internal hollow cores with walls having a thickness depending upon the distance of the walls of the cavities 2 from the walls of the members 22.

After hardening the core, the mobile die part 1'' is moved away from the die 1' (FIG. 3) and, when it is moving rearwardly, the core is ejected or extracted from the stationary die part 1'. This operation, in addition to the urging action of the springs 8, 9, 10 and 11 on the bars 4, 5, 6 and 7, may be assisted by means of ejecting devices in the hollow parts 3 associated with the die parts 1' and 1'' which ejecting devices have not been indicated, since they are known in the art. The bars 29 and 30 have the rear ends pivotally connected to an extension 34 of the mobile die part 1'', and therefore, during the rearward motion of the die 1'' away from the die part 1', the bars 29 and 30 slide through the holes in the rotatable members 27 and 28 of the levers 25 and 26 respectively.

The continuous sliding will stop when the die part 1'' is sufficiently apart from the die part 1' to permit the pivoting action of the members 22 to take place. At this point, the enlarged ends 29' and 30' of the bars 29 and 30 will abut the rotatable members 27 and 28 respectively and accordingly further movement of the bars 29 and 30 will cause the levers 25 and 26 to pivot causing the pivoting action of the bracket 18, the support bar 21, the members 22 bearing the cores 35, the stem 20 and the jack 19 (FIG. 4).

In the FIG. 4, the pivotting movement is approximately 90°, and the core 35 is taken to the horizontal, or second position, where the core 35 extends beyond the web 24' of the shoulder 24 with the projecting portions of the members 22 resting respectively in the slots 24'' in the web 24'.

At this point, the jack 19 is operated to retract the members 22 to extract them out of the core 35 while the latter is held by the web 24'. The extraction operation may be assisted by the simultaneously movement of the web 24' through movement of the conveyor belt 23.

According to a modification, a partial extraction of the members 22 may be carried out while the die parts 1' and 1'' are still in the closed position (as shown in FIG. 2), and immediately after completion of the hardening of the core 35. When this operation is carried out, the partial extraction will ensure the release of the core from the members 22 by merely moving the core on the conveyor belt 23 where the subsequent motion of the web 24' on the conveyor belt 23 is sufficient to ensure positive extraction of the members 22 from the core.

The invention may be used in other forms also while within the boundaries of the invention as claimed herein, as those skilled in the art will understand.

I claim:

1. Apparatus for moulding a hollow foundry core, comprising a pair of mould parts having parallel end faces abutting in closed position of said mould parts against each other, at least one of said mould parts being movable relative to the other to an open position in which said end faces are spaced from each other, said mould parts having complementary cavity portions forming in said closed position of said mould parts at least one cavity; at least one elongated member extending in a first position thereof and in said closed position of said mould parts into said cavity and closing the latter at one end thereof; means for filling said cavity through the other end thereof with moulding material so that the latter forms a hollow core about said member; support means supporting said member for pivotal movement from said first to a second position in which said member and said core thereon are moved out of the space between said end faces when said mould parts are in said open position; means connecting said one mould part to said support means for pivoting said at least one member to said second position upon movement of said one mould part to said open position; and moving means to move the core and said member in said second position relative to each other to remove said core from said elongated member, including a conveyor having a run extending parallel to said member when the latter is in said second position, and means on said conveyor for engaging the core on said member for moving the core in longitudinal direction of said member off the latter.

2. Apparatus as defined in claim 1, wherein said connecting means comprise a lost motion connection between said one mould part and said connecting means so that said at least one member is pivoted to said second position only when said one mould part approaches its maximum distance from the other of said mould parts.

3. Apparatus as defined in claim 2, and including biasing means for biasing said at least one member to its first position during movement of said one mould part towards the other of said mould parts.

4. Apparatus as defined in claim 1, wherein said support means are arranged outside of the path of movement of said one mould part and wherein said removing means comprise a fluid operated jack connected to at least said one member for moving the same in longitudinal direction and opposite to the direction the core is moved by said means on said conveyor, said jack being carried by said support means to pivot therewith between said first and said second position.

5. Apparatus as defined in claim 4, wherein said support means comprises a U-shaped bracket having short arms on opposite ends thereof, said jack being carried by said bracket and having a stem projecting through an aperture in said bracket and being connected to said at least one member, two main arms, each pivotally connected at one end to a respective short arm of said bracket, means mounting said main arms movable in direction of movement of said one mould part away from the other of said mould parts, and means for biasing said main arms away from said other mould part upon movement of said one mould part away from said other mould part.

6. Apparatus as defined in claim 5, wherein said mould parts are mounted in a frame and wherein said mounting means of said main arms comprise a plurality of parallel bars slidably supported by said frame.

7. Apparatus as defined in claim 1, wherein each of said mould parts has a plurality of complementary cavity portions, and wherein said apparatus comprises a plurality of elongated members respectively extending in said first position thereof into the cavities formed by said complementary cavity portions in said closed position of said mould parts.

8. Apparatus as defined in claim 1, and including means connected to said support means for moving the latter and said at least one member supported thereon away from the other of said mould parts upon movement of said one mould part away from said other mould part.

* * * * *